US006938741B2

(12) United States Patent
Hsien et al.

(10) Patent No.: US 6,938,741 B2
(45) Date of Patent: Sep. 6, 2005

(54) COLLAPSIBLE BAR ASSEMBLY FOR SUPPORTING A SECONDARY BAG ON WHEELED LUGGAGE

(75) Inventors: Tsai Chen Hsien, Taichung Hsien (TW); Tie Yi Tang, Taichung Hsien (TW); Timm J. Fenton, Lebanon, NJ (US); Paul V. Scicluna, Penndel, PA (US)

(73) Assignee: Tumi, Inc., South Plainfield, NJ (US)

( * ) Notice: Subject to any disclaimer, the term of this patent is extended or adjusted under 35 U.S.C. 154(b) by 28 days.

(21) Appl. No.: 10/394,291

(22) Filed: Mar. 21, 2003

(65) Prior Publication Data

US 2004/0182663 A1 Sep. 23, 2004

(51) Int. Cl.[7] ..... A45C 3/00

(52) U.S. Cl. ..... 190/108; 190/18 A; 190/102; 190/115

(58) Field of Search ..... 190/108, 18 A, 190/115, 11, 117, 118, 102

(56) References Cited

U.S. PATENT DOCUMENTS 3,319,744 A * 5/1967 William ..... 190/108
5,474,162 A 12/1995 Shyr et al.
5,788,032 A 8/1998 Krulik
5,927,451 A 7/1999 Tsai
5,941,352 A * 8/1999 Lee ..... 190/11
5,943,936 A 8/1999 Deliman et al.
6,062,357 A 5/2000 Bogert
6,237,734 B1 * 5/2001 Chen ..... 190/18 A
6,644,447 B2 * 11/2003 Pohl ..... 190/8

FOREIGN PATENT DOCUMENTS

WO 0152687 7/2001

OTHER PUBLICATIONS www.thefreedictionary.com.*

* cited by examiner

*Primary Examiner*—Tri M. Mai
(74) *Attorney, Agent, or Firm*—Baker Botts LLP

(57) ABSTRACT

A wheeled luggage item includes a collapsible bar assembly for stably supporting a secondary bag on top of the luggage item. The collapsible bar assembly includes a base mounted on top of the luggage and a generally U-shaped bar member having two ends respectively pivoted to the base. The bar member can be pivoted between a collapsed position, at which the bar member rests against the base, and an extended position, at which the bar member extends outwardly at an angle of about 90° to the base. Releasable locking means disposed on the base lock the bar member at the collapsed position. A push-button releases the bar member from the collapsed position, and an elastic member captured between the base and the bar member biases the bar member upward away from the collapsed position.

17 Claims, 7 Drawing Sheets

COLLAPSIBLE BAR ASSEMBLY FOR SUPPORTING A SECONDARY BAG ON WHEELED LUGGAGE

BACKGROUND OF THE INVENTION

1. Technical Field of the Invention

The present invention relates generally to luggage, and more particularly to a collapsible bar assembly for stably supporting a secondary bag on a wheeled luggage item.

2. The Related Art

FIG. 1 shows a conventional wheeled luggage item or case 10 which has a conventional doubled-tubed retractable handle 12. When the handle 12 is in the extended position shown from the rear in FIG. 1, a briefcase or other secondary bag 14 with a mounting strap (or rear pocket) 16 can be slipped over the handle 12 and rest on top of the luggage 10, so that the luggage 10 can carry more baggage while being pulled. This is a desirable convenience for the traveler, as it allows a free hand while wheeling the baggage. It also raises the bag 14 higher from the ground, which facilitates access to the bag.

Although a pull handle 12 having widely spaced telescopic tubes will adequately support the bag 14 during such movement, a single-tubed handle or a handle with narrowly spaced telescopic tubes often will not. In such case, the bag 14 tends to tremble randomly as the wheeled luggage 10 is moved and frequently falls off the luggage 10 and hangs on the handle tube(s). This interferes significantly with the ease with which the luggage 10 can be handled by the user, and may lead to damage of the bag 14 or the handle 12.

The present invention overcomes these and other disadvantages of the prior art.

SUMMARY OF THE INVENTION

It is therefore an object of the present invention to provide a collapsible bar assembly for stably supporting a secondary bag on a wheeled luggage item regardless of the width of the pull handle for the wheeled item.

In accordance with the present invention, a collapsible bar assembly mounted on a wheeled luggage item includes a base mounted on the top of the luggage, a bar member pivoted on the base for movement between a collapsed position, at which the bar member rests on the base, and an extended position, at which the bar member extends outwardly away from the base, and means for releasably locking the bar member in the collapsed position. The bar member has a greater extent in the widthwise direction of the case than does the pull handle. Because of its greater transverse width, the bar member provides a larger transverse supporting surface area than a single-tubed or narrow pull handle. This enables a secondary bag to be securely held on top of the wheeled luggage during travel. The secondary bag may include a strap or pocket on its rear side for slipping over the bar member, or, where the handle structure of the secondary bag permits, the bag handle may be slipped over the tube(s) of the pull handle. So positioned, the secondary bag rests stably against the bar member when the luggage item is tilted and pulled on the wheels.

In an exemplary embodiment, the bar member is generally U-shaped transversely of the luggage item and is pivotally connected at its ends to the base for movement between the collapsed position, at which it lays flat against the top of the baggage item, and the extended position. An elastic member captured between the bar member and the base biases the bar member away from the base upon release of the locking means to facilitate manual movement of the bar member to the extended portion.

DETAILED DESCRIPTION OF EXEMPLARY EMBODIMENT OF THE INVENTION

Figure 2:
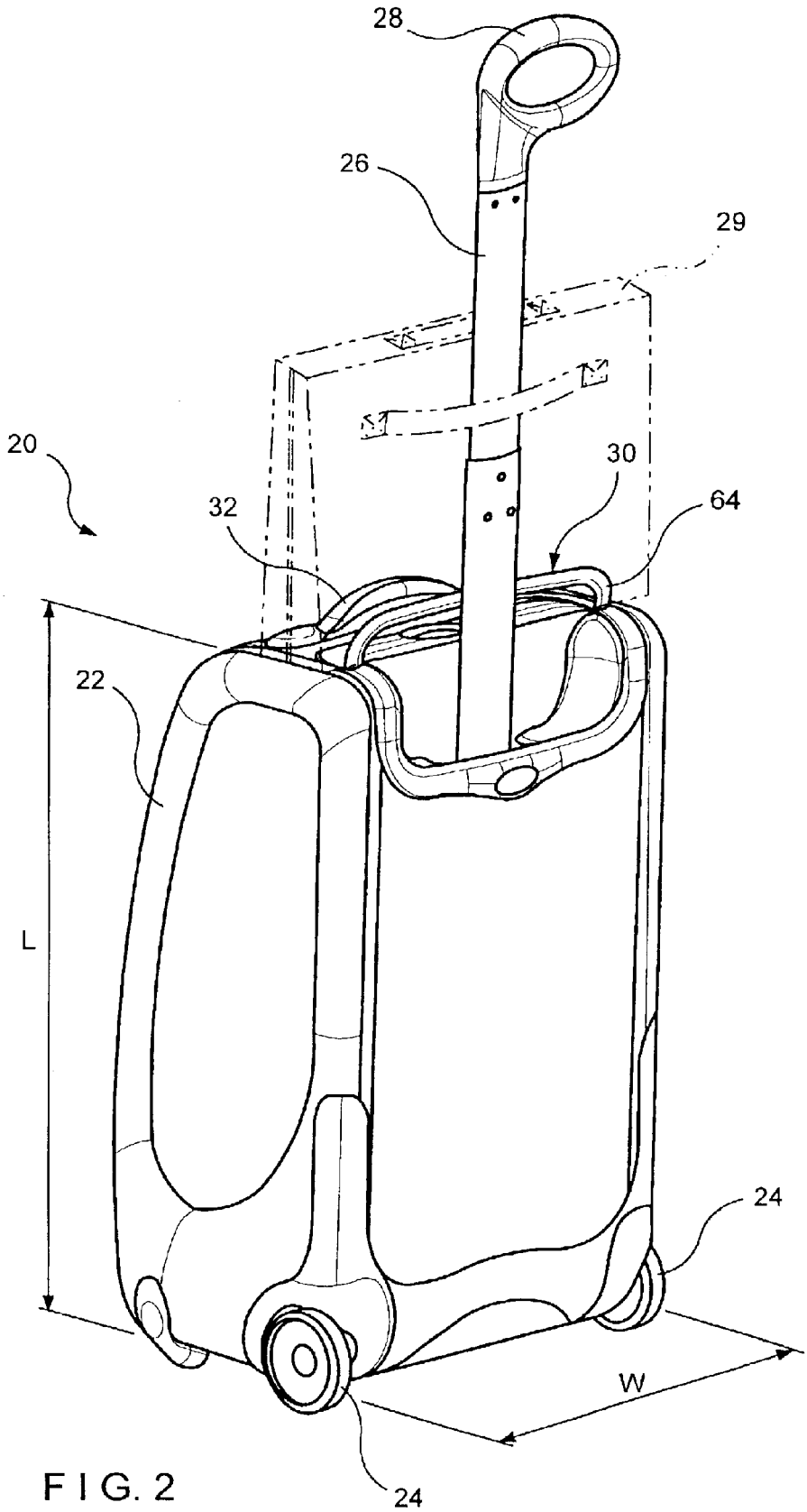
FIG. 2 shows a rear perspective view of a wheeled luggage item according to an exemplary embodiment of the present invention.

With reference to FIG. 2, a wheeled luggage item 20 in accordance with an exemplary embodiment of the invention includes a case 22, two wheel assemblies 24 disposed at the bottom of the case 22, a single-tubed retractable handle 26 at the top of the case 22, having a pull handgrip 28 at the distal end thereof, and a collapsible bar assembly 30 installed on the top of the case 22. A handgrip 32 may be provided on the topwall of the case adjacent to the bar assembly 30. For convenience of reference herein, the case 22 may be considered as having a lengthwise extent L from the top to the bottom and a widthwise extent W transverse to the length L.

Figure 3:
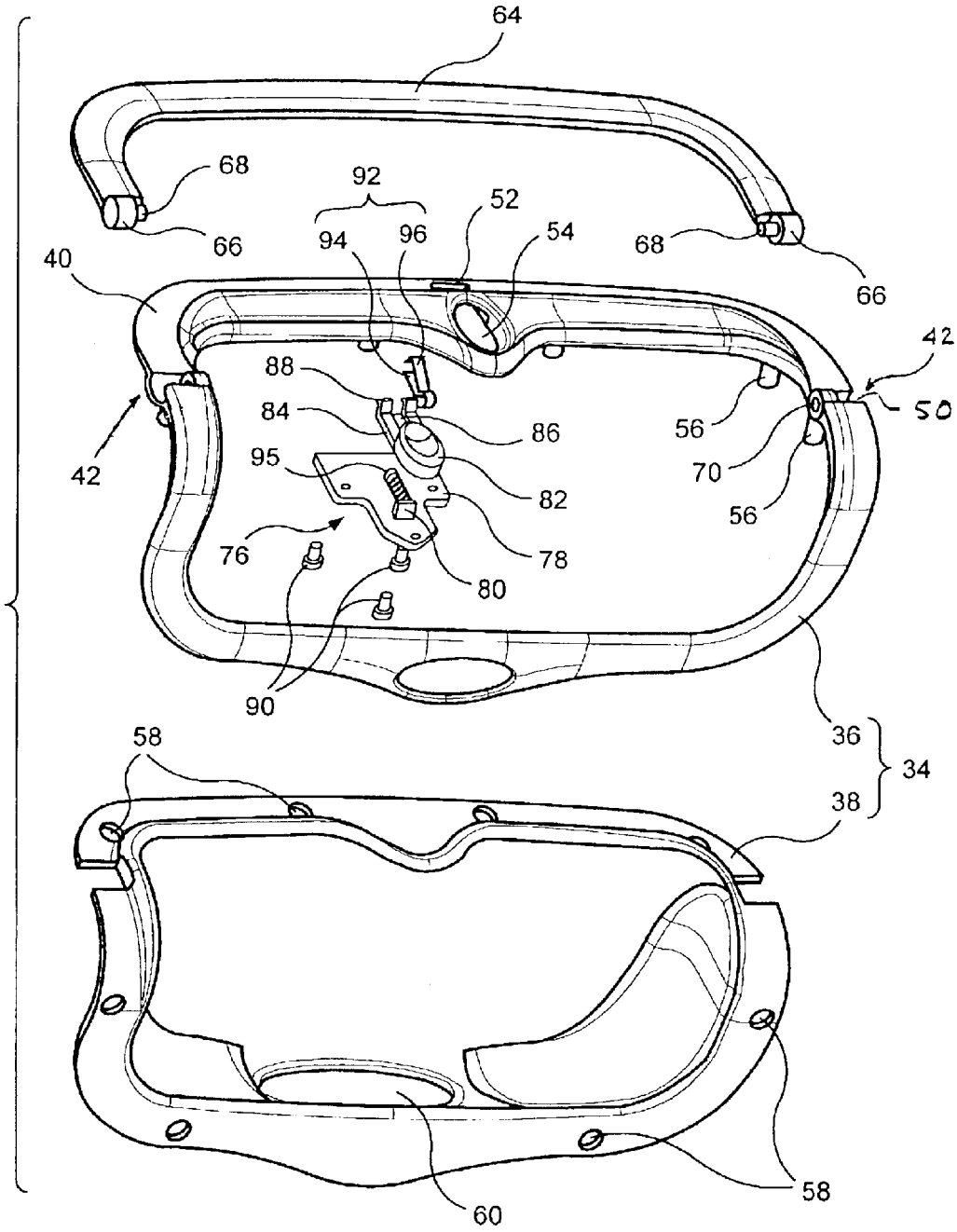
FIG. 3 shows an exploded view of the bar assembly of the embodiment of FIG. 2.
Figure 6:
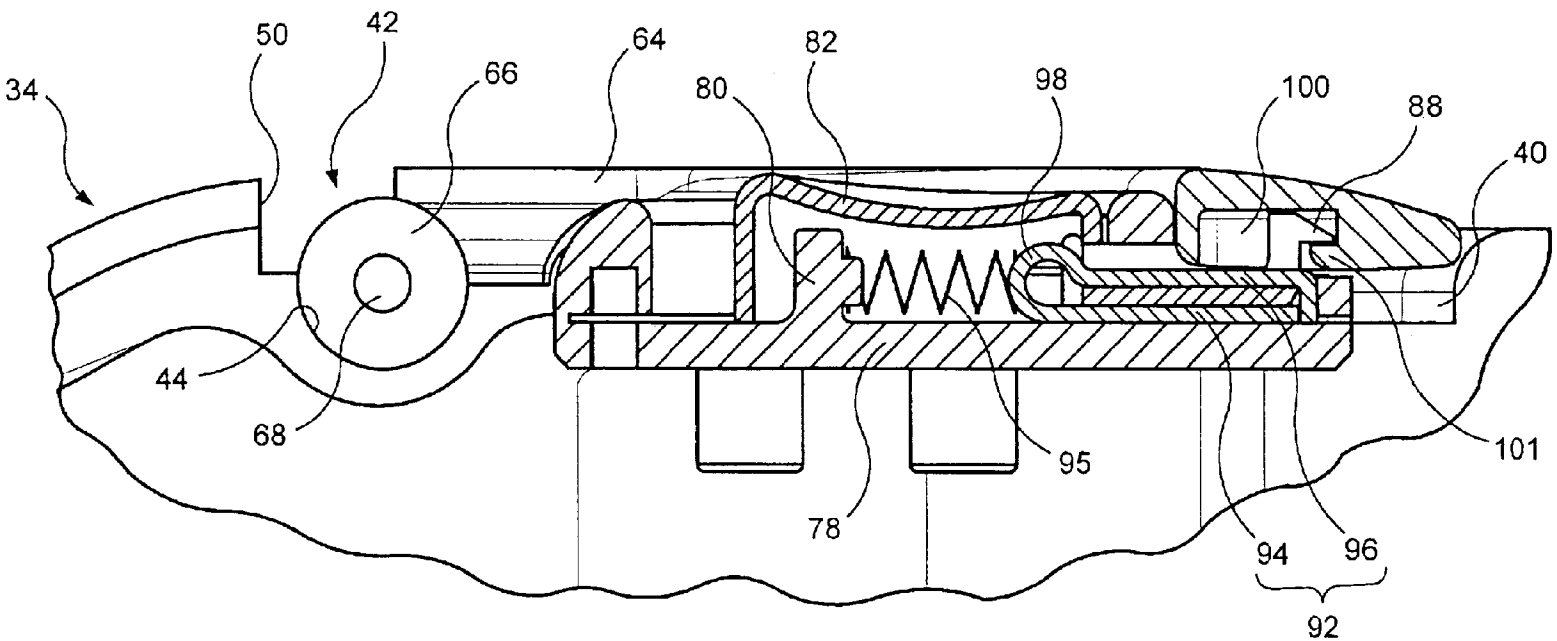
FIG. 6 is a partial sectional view of the bar assembly of the embodiment of FIG. 2, showing a locking device for locking the bar member in the collapsed position.

As shown in FIG. 3, the bar assembly 30 includes a base 34 comprising a first sub-base 36 and a second sub-base 38 which combine together. The first sub-base 36 is a hollow frame having an approximately U-shaped channel 40 along the perimeter on one side. Two chases 42, each of which includes a circular surface 44 at the bottom side thereof, are respectively located at the two ends of the channel 40 of the first sub-base 36 (FIG. 6). A block wall 50 is formed at a side of each chase 42. A gap 52 is disposed at the middle of the channel 40 (FIG. 3). The first sub-base 36 is provided with an opening 54 beside the channel 40, which corresponds to the gap 52 in the channel 40. A plurality of posts 56 located on the underside of the first sub-base 36 extend through ports 58 in the second sub-base 38 for mounting the first sub-base 36 and the second sub-base 38 on the top of the case 22 by screws (not shown). The second sub-base 38 has a hole 60 for the retractable handle 26 to extend through.

Figure 1:
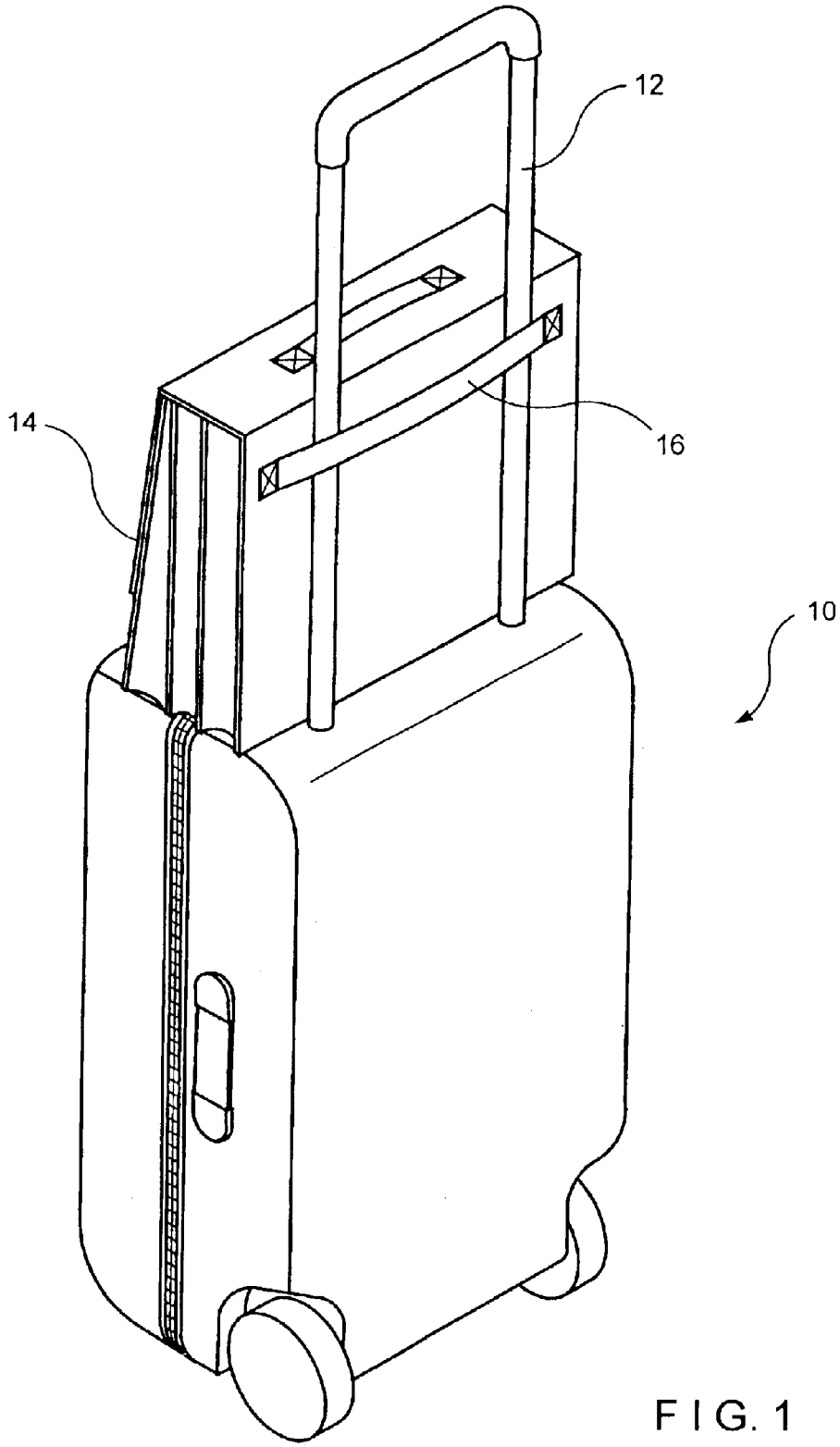
FIG. 1 PRIOR ART
FIG. 1 shows a rear perspective view of a conventional wheeled luggage item with a briefcase supported thereon.
Figure 4:
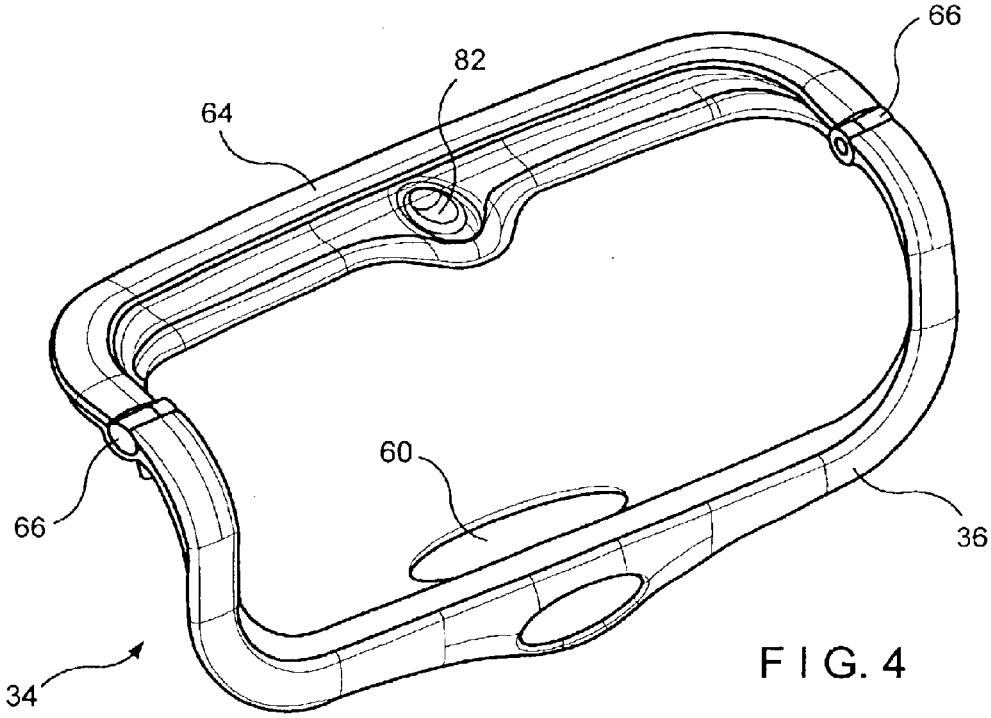
FIG. 4 is a perspective view of the bar assembly of the embodiment of FIG. 2, showing the bar member in the collapsed position.
Figure 5:
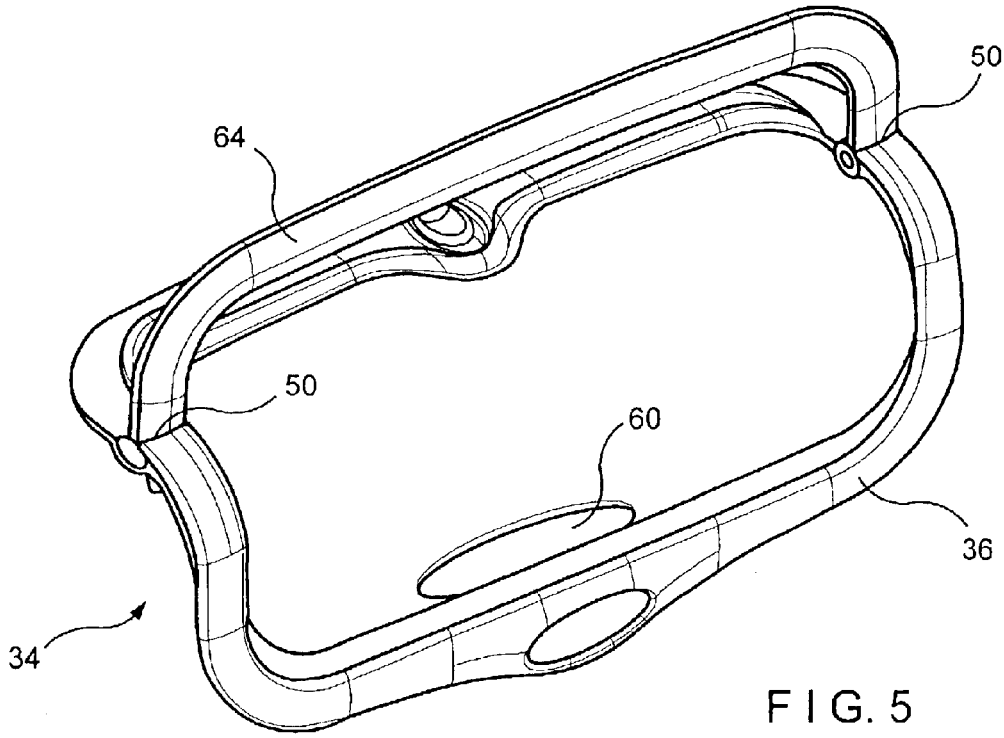
FIG. 5 is a perspective view of the bar assembly of the embodiment of FIG. 2, showing the bar member in the extended position.

A U-shaped bar member 64 corresponds to the channel 40 on the base 34. The bar member 64 has two cylindrical pivot members 66 at its respective ends. The pivot members 66 are respectively received in the chases 42 on the first sub-base 36, and engage the circular surfaces 44 thereof. A pivot pin 68 is molded on the axial inner side of each pivot member 66, and is received in a bore 70 in the first sub-base 36, whereby the bar member 64 is pivotally mounted on the first sub-base 36 so as to be movable between a collapsed position, as shown in FIG. 4, at which the bottom side of the bar member 64 is received in the channel 40 of the base 34, and an extended position, shown in FIGS. 5 and 8, at which the bar member 64 is pivoted outwardly at an angle of about 90°. At the extended position of FIG. 8, the block walls 50 in the chases 42 bear against the bar member 64 so as to prevent the bar member 64 from rotating further outwardly. Under the weight of a secondary bag 29 resting on the bar member 64, the upper portion 64*a* of the bar assembly 64 bears against the telescopic tube of the handle 26 for additional support. For clarity, the handle 26 and the secondary bag 29 are shown in phantom in FIG. 8. To provide adequate support for a secondary bag, the bar member 64 preferably has a transverse extent (in the direction of the width W of the case 22) at least as great as or slightly greater than the spacing between the dual tubes of the conventional telescopic handle. (FIG. 1)

With reference again to FIG. 3, a locking device 76 comprises a base plate 78 having an upright post 80 thereon, a button 82 having an arm 84 projecting from a lateral side of the bottom thereof, the arm 84 having a recess 86 in its top side and two hooks 88 at the free end thereof. (See also FIG. 6.) The button 82 rests on the base plate 78 so as to be slidable between a locked position shown in FIG. 6 and an unlocked position shown in FIG. 7. The base plate 78 is disposed between the first sub-base 36 and the second sub-base 38 of the base 34 and is fastened firmly to the underside of the first sub-base 36 by screws 90. So fixed, the top end of the button 82 extends upwardly out of the opening 54 of the first sub-base 36, the arm 84 extends from the opening 54 to the gap 52 in the channel 40, and the hooks 88 extend upwardly out of the gap 52.

A generally V-shaped elastic member 92 includes two arms 94, 96 that are joined together at one end by a curved central section 98 (FIGS. 3 and 6). The first arm 94 of the elastic member 90 is received within the recess 86 in the arm 84 of the locking device 76, such that the second arm 96 is suspended thereabove. The end of the second arm 96 extends out of the gap 52 of the channel 40 between the locking device 76 and the hooks 88. The elastic member 92 is also slidable along the plate 78. A compression spring 95 is captured between the post 80 and the central section 98 so as to bias the elastic member 92 to right in FIG. 6.

As shown in FIG. 6, when the bar member 64 is in the collapsed position and the button 82 is in the locked position, the hooks 88 of the locking device 76 are received in a recess 100 located centrally of the bottom side of the bar member 64 and engage a lip 101 on the bar member. The bar member 64 is then secured at the collapsed position. In that position, the bar member 64 deflects or compresses the second arm 96 of the elastic member 92 about the central section 98.

Figure 7:
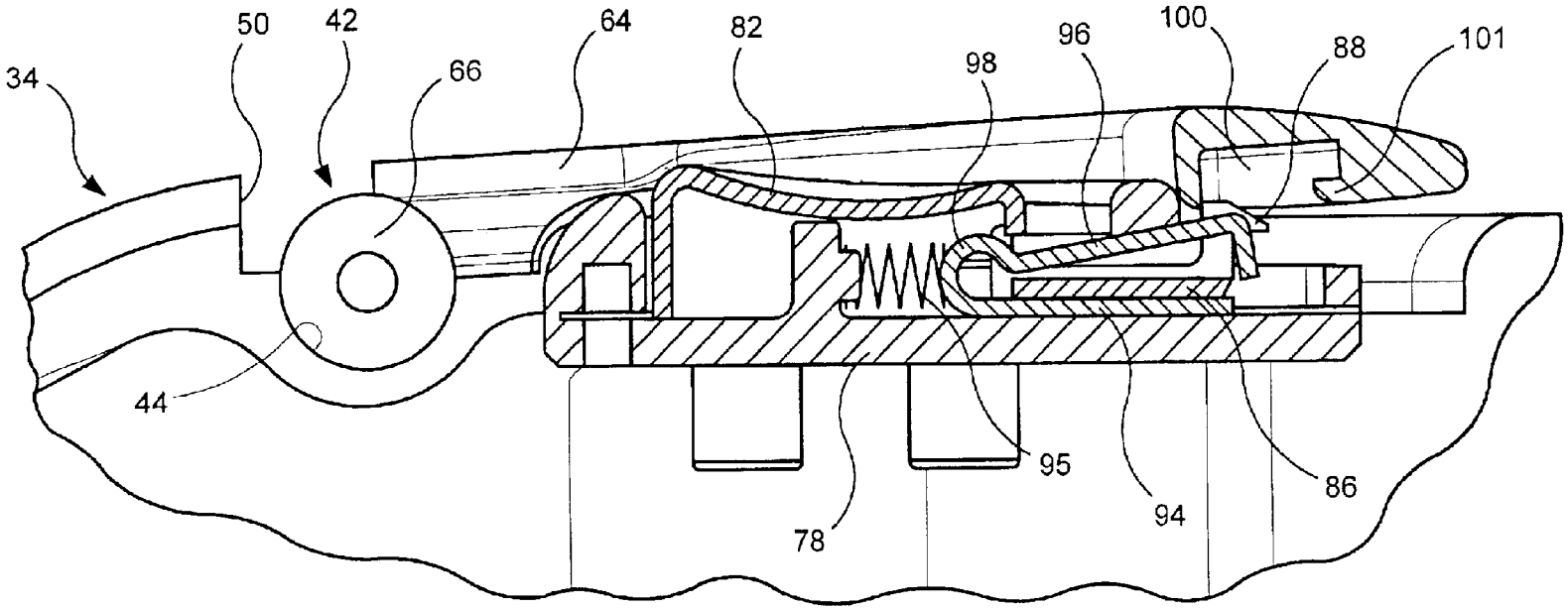
FIG. 7 is a sectional view similar to FIG. 6, showing the bar member released by the locking device, and the bar member then biased upwardly by an elastic member.

When it is desired to use the bar assembly 30 to support a secondary bag on the case 22, the button 82 is pushed to the unlocked position of FIG. 7, against the bias of the spring 95, to disengage the hooks 88 of the locking device 76 from the lip 101 of the bar member 64. As shown in FIG. 7, the elastic member 92 is pulled to the left by the button 82. The bar member 64 will thereupon be biased outwardly to a released position (as shown in FIG. 7) by the second arm 96 of the elastic member 92. The bar member 64 may then be rotated by hand towards the fully extended position of FIG. 8.

Figure 8:
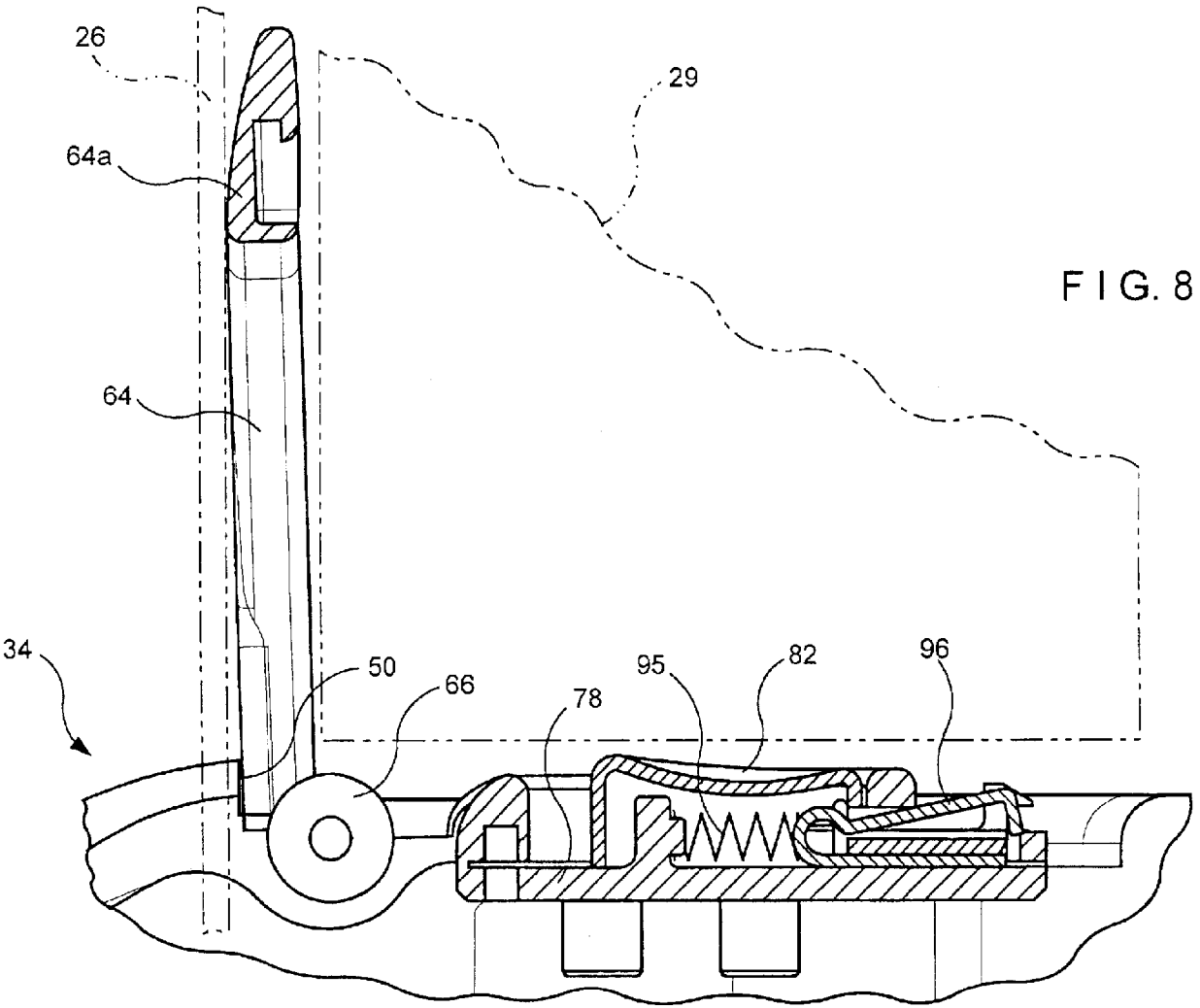
FIG. 8 is a sectional view similar to FIG. 7, showing the bar member pivoted to the extended position.

When the bar member 20 is rotated to the extended position of FIG. 8, the block walls 50 of the chases 42 bear against the bar member 64 to stop the bar member 64 from further outward rotation. As a result, a briefcase or other secondary bag 29 can be placed on top of the case 10 and stably supported thereon by the upright bar member 64, as shown in FIGS. 2 and 8.

When the bar member 64 is not in use, it can be rotated to the collapsed position, where it will be automatically locked in place by the locking device 76.

The components of the bar assembly 30 are, to the extent practicable, preferably made of molded materials, e.g., by injection molding, blow molding, etc., or of stamped metal, so that they can be easily and inexpensively replaced or repaired if damaged.

Although the invention has been described by reference to specific embodiments thereof, it will be understood to those skilled in the art that many alternatives, modifications and variations thereof may be made without departing from the inventive concepts disclosed. All such alternatives, modifications and variations, therefore, are intended to be included within the spirit and scope of the appended claims.

What is claimed is:

1. A wheeled luggage item, comprising:

a case having wheels at the lower end thereof and a pull handle at the upper end thereof;

a base mounted on the upper end of the luggage item;

a bar member pivoted on said base for movement between a collapsed position, at which a substantial portion of the bar member rests against said base, and an extended position, at which a substantial portion of the bar member extends outwardly from said base, said bar member having a greater extent transversely of said case than said pull handle;

means for releasably locking said bar member at the collapsed position; and said bar member, when in said extended position, providing a supporting surface for stably supporting a secondary bag on top of the wheeled luggage item.

2. The luggage item of claim 1, wherein said bar member comprises a U-shaped bar having a pivotal connection at each end thereof to said base.

3. The luggage item of claim 1, wherein said base includes a channel, at least a part of said bar member being received within said channel in the collapsed position.

4. The luggage item of claim 2, wherein said base includes a block wall adjacent to each of said pivotal connections against which said bar member bears when in the extended position.

5. The luggage item of claim 1, further comprising an elastic member, disposed between said base and said bar member, by which said bar member is biased outwardly away from said base after it is released from said collapsed position.

6. The luggage item of claim 5, wherein said elastic member comprises a generally V-shaped elastic member having first and second legs resiliently connected at one end thereof by a control section, wherein said first arm rests against said base and, in the collapsed position of said bar member, said bar member compresses said second arm towards said base.

7. The luggage item bar assembly of claim 6, wherein said releasable locking means includes a button on said base, a cantilevered arm extending outwardly along a lateral side of said button, and a hook at the free end of said cantilevered arm.

8. The luggage item of claim 7, further comprising a base plate mounted on said base, said base plate having a post thereon, and a compression spring operatively interposed between said post and the closed end of said V-shaped elastic member.

9. The luggage item of claim 2, wherein each pivotal connection includes a pivot member on said bar member, said base includes two chases in which respective ones of said two pivot members are received, and a pivot pin for pivotally connecting each of said pivot members and said base.

10. The luggage item of claim 9, wherein:

each of said pivot connections comprises a cylindrical surface on the end of said bar member; and each of said cylindrical surfaces is received within one of said chases.

11. The luggage item of claim 1, wherein said base comprises a first sub-base and a second sub-base, said first sub-base having a channel and a chase disposed at each end of said channel, said bar member including a pivot connecting member at each end thereof, one of said pivot connecting members being received in each chase, a pivot pin carried by each said pivot connecting member, and a bore in a side wall of each chase for receiving the respective pivot pin.

12. The luggage item of claim 11, wherein said first sub-base includes an opening connected to a gap in said channel, a button including an arm cantilevered thereto at one end and having two hooks at the free end thereof, a base plate including a post on which said button bears, said base plate being mounted between said first sub-base and said second sub-base such that said button extends out of said opening and said hooks extend out of said gap.

13. The luggage item of claim 12, further comprising an elastic member, one end of which rests against said cantilevered arm, the other end of which extends out of said gap.

14. The luggage item of claim 1, wherein said pull handle comprises a single-tubed retractable handle, one end of which fastened to said case, the other end of which extends upwardly out of the top of said case and includes a handgrip at the distal end thereof.

15. A wheeled luggage item, comprising:

a case having wheels at the lower end thereof and a pull handle at the upper end thereof;

a base mounted on the upper end of the luggage item;

a bar member pivoted on said base for movement between a collapsed position, at which a substantial portion of the bar member rests against said base, and an extended position, at which a substantial portion of the bar member extends outwardly from said base, said bar member having a greater extent transversely of said case than said pull handle;

means for releasably locking said bar member at the collapsed position; and said bar member, when in said extended position, providing a supporting surface for stably supporting a secondary bag on top of the wheeled luggage item while the wheeled luggage item is pulled on the wheels.

16. A wheeled luggage item, comprising:

a case having wheels at the lower end thereof and a pull handle at the upper end thereof;

a base mounted on the upper end of the luggage item;

a bar member pivoted on said base for movement between a collapsed position, at which the bar member rests against said base, and an extended position, at which the bar member extends outwardly from said base, said bar member having a greater extent transversely of said case than said pull handle;

means for releasably locking said bar member at the collapsed position; and said bar member, when in said extended position, providing a supporting surface for stably supporting a secondary bag on top of the wheeled luggage item;

wherein said bar member comprises a U-shaped bar having a pivotal connection at each end thereof to said base.

17. A wheeled luggage item, comprising:

a case having wheels at the lower end thereof and a pull handle at the upper end thereof, a base mounted on the upper end of the luggage item;

a bar member pivoted on said base for movement between a collapsed position, at which the bar member rests against said base, and an extended position, at which the bar member extends outwardly from said base, said bar member having a greater extent transversely of said case than said pull handle;

means for releasably locking said bar member at the collapsed position; and said bar member, when in said extended position, providing a supporting surface for stably supporting a secondary bag on top of the wheeled luggage item;

an elastic member, disposed between said base and said bar member, by which said bar member is biased outwardly away from said base after it is released from said collapsed position.

* * * * *